United States Patent [19]

Connell

[11] 4,046,410

[45] Sept. 6, 1977

[54] FOUR WAY SECURITY DOOR

[76] Inventor: Robert I. Connell, 896 S. Main St., Mount Holly, N.C. 28120

[21] Appl. No.: 690,566

[22] Filed: May 27, 1976

[51] Int. Cl.[2] ..... E05C 1/12

[52] U.S. Cl. ..... 292/36; 292/66

[58] Field of Search ..... 292/5, 34, 36, 37, 64, 292/66, 109, 113; 70/144, 125

[56] References Cited

U.S. PATENT DOCUMENTS

| | | | |
|---|---|---|---|
| 813,595 | 2/1906 | Shive | 292/36 |
| 902,412 | 10/1908 | Jones | 292/36 |
| 1,021,740 | 3/1912 | Leighton | 292/36 |
| 1,282,115 | 10/1918 | Older | 292/36 |
| 1,366,015 | 1/1921 | Morris | 292/5 X |
| 1,811,312 | 6/1931 | Fildes | 292/36 X |
| 1,909,697 | 5/1933 | MacBeth et al. | 292/36 |
| 2,209,727 | 7/1940 | Gibson | 292/36 |
| 2,823,536 | 2/1958 | Watson | 292/36 X |
| 3,088,548 | 5/1963 | Behrens et al. | 292/36 X |
| 3,751,949 | 8/1973 | Castle | 70/144 |

*Primary Examiner*—J. Franklin Foss

*Attorney, Agent, or Firm*—Bell, Seltzer, Park & Gibson

[57] ABSTRACT

A security door assembly adapted for securing a single or double door in locking engagement with an adjacent door jamb structure. In the interior of a hollow door is located a locking assembly which includes a rotatably mounted plate member and a plurality of elongate locking members. The locking members have their proximal end portions connected to the plate member with respective distal end portions of the locking members being positioned for protruding through respective peripheral edges of the door. An operating level located on one face of the door is connected to the plate member to permit rotating the same inside the door. When the plate member is rotated, the respective locking members are moved longitudinally to protrude from the respective peripheral edges of the door and engage the adjoining door jamb structure and floor to lockingly secure the door in place.

10 Claims, 8 Drawing Figures

FOUR WAY SECURITY DOOR

The present invention relates to a security door arrangement for securing single or double doors, such as the type of doors commonly provided at the side or rear of stores or other commercial or industrial establishments.

Various methods have been employed for securing doors of this type to prevent forced entry by burglars. For example, use has been made of dead bolt locks, bars which may be positioned across the width of the doorway to prevent the doors from being opened, or various door attachments, such as the security bar assembly disclosed in my copending U.S. patent application Ser. No. 598,201, filed July 23, 1975.

It is an object of the present invention to provide a specially constructed security door which may be used singly or in pairs and which does not require external attachments or devices for locking but has a self-contained locking assembly therein. More particularly, it is an object of this invention to provide a security door assembly having a self-contained locking assembly therein adapted for securing the sides of the door in locking engagement with an adjacent door jamb structure. In accordance with the invention a plurality of locking members in the form of elongate slideable bars are located inside a hollow door and serve to secure the door to the adjoining jamb structure at the sides as well as at the top and bottom. Where the doors are installed in pairs, the locking members secure the doors to the adjoining jamb structure at the top, bottom, and sides, as well as securing the doors to one another.

Some of the objects and features of the invention having been stated, others will appear when taken in connection with the accompanying drawings, in which —

Figure 1:
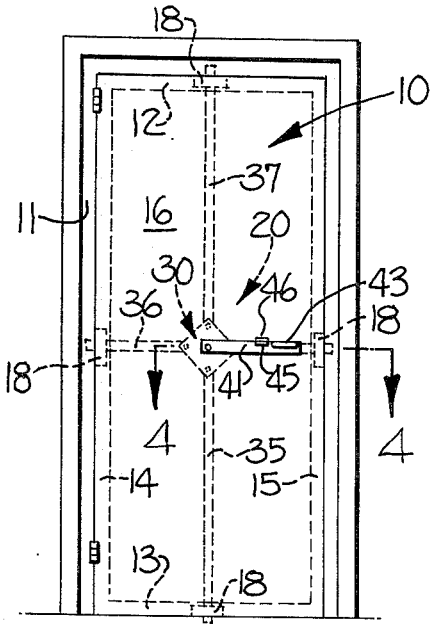
FIG. 1 is an elevational view showing the interior side of a security door in accordance with this invention, the locking assembly being illustrated in broken lines in the locked position.
Figure 2:
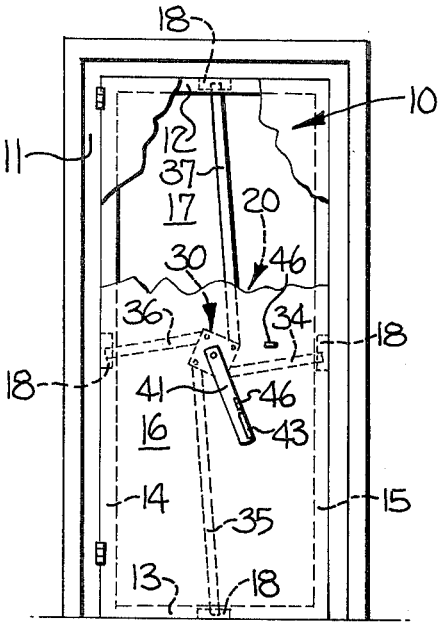
FIG. 2 is a view similar to FIG. 1, but with portions of the interior facing of the hollow door broken away to reveal the door frame, and with the locking assembly being illustrated in the unlocked position.

Referring now more particularly to the drawings, FIGS. 1 and 2 show a door 10 which is hingedly connected along one side thereof to an adjoining door jamb structure 11 which extends along the top and both sides of the door.

As shown more particularly in FIG. 2, the door 10 includes a substantially rectangular frame defining the peripheral edges of the door. The frame includes an upper member 12, a lower member 13, and opposing side members 14 and 15. The door also includes front and rear substantially rectangular panels, 16 and 17 respectively, which are mounted on opposite sides of the rectangular frame coextensive therewith and which define the front and rear faces of the door with a hollow interior portion being located between the front and rear panels 16 and 17. As illustrated, the frame members 12, 13, 14 and 15 are formed from substantially U-shaped cross-section channel members of a suitable strong material such as steel. The panels 16 and 17 which define the front and rear faces of the door may be of any suitable material, such as wood, or preferably steel. Each frame member 12, 13, 14 and 15 has a slot-like opening formed therein near the midpoint of its length, and a guide member 18 is secured to each respective frame member overlying the location of the slot-like opening. As shown more particularly in FIG. 3, the guide member 18 is a substantially U-shaped member having leg portions **18*a* attached to the frame member and a medial portion 18*b*** which is spaced from the frame member and with a slot-like opening therethrough corresponding to the size of the slot-like opening in the respective frame member.

A locking assembly, generally indicated at 20, is located within the hollow interior portion of the door 10 and may be operated from one side of the door to lockingly secure the door to the adjoining door jamb structure and to the floor therebelow. The locking assembly includes a rotatable plate assembly generally indicated at 30, which, as illustrated, is located adjacent the middle of the height and width of the door. This rotatable plate assembly is mounted for rotation within the door between a pair of opposing substantially parallel frame members 22, 23 which extend between the opposing side frame members 14 and 15. These additional frame members 22, 23 are interconnected by spacers 24 which maintain the frame members 22, 23 in spaced apart relation so that the frame members reinforce and support the respective interior surfaces of the front and rear panels 16 and 17.

Figure 3:
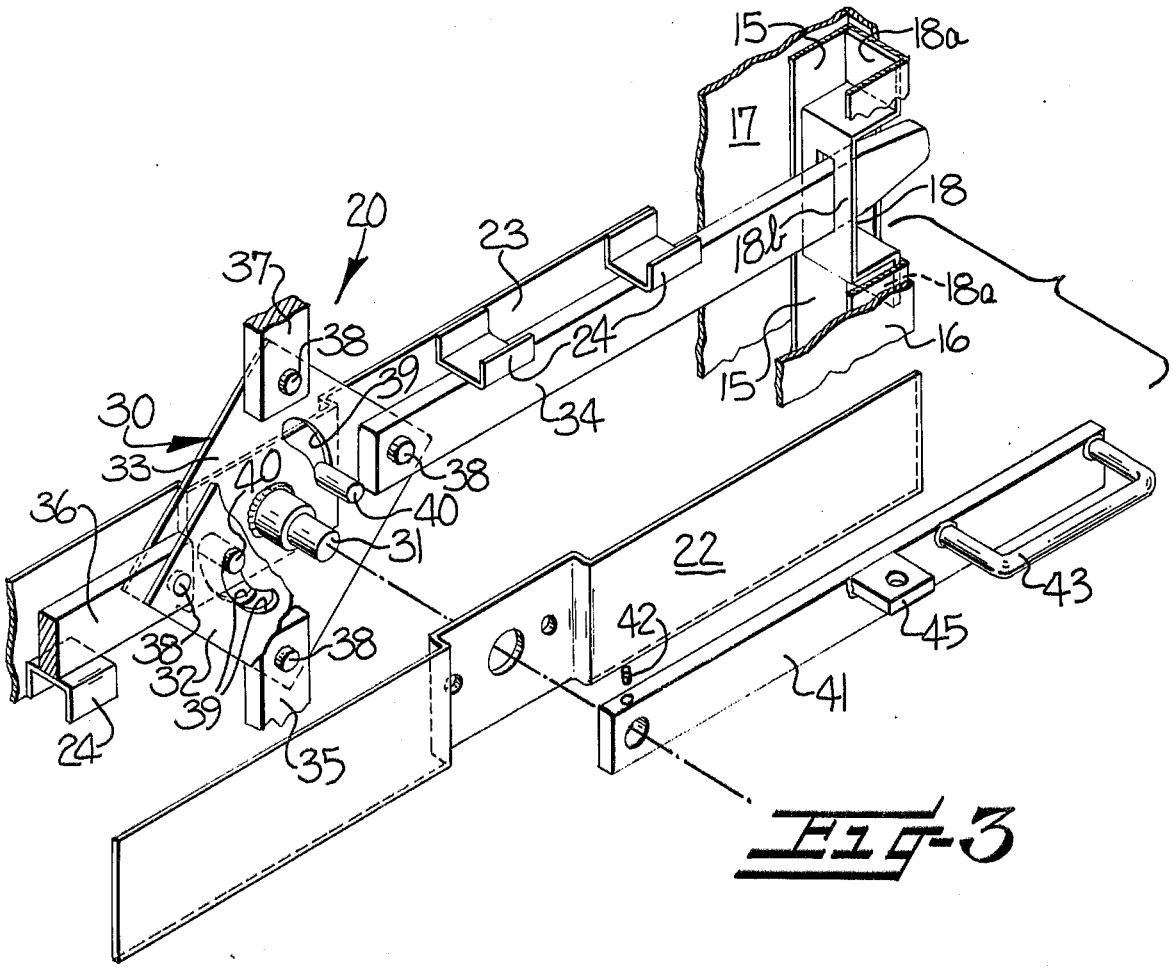
FIG. 3 is an enlarged exploded perspective view showing some of the components of the locking assembly in the interior of the security door.
Figure 4:
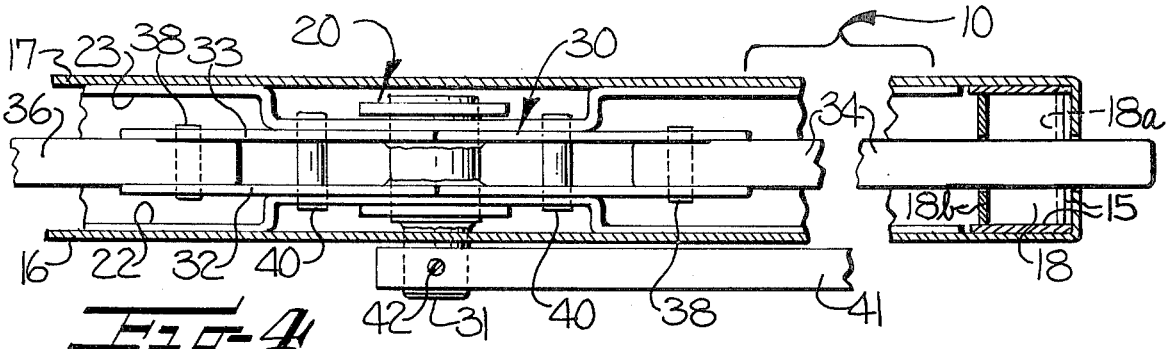
FIG. 4 is an enlarged fragmentary sectional view of the locking assembly taken substantially along the line 4—4 of FIG. 1.
Figure 5:
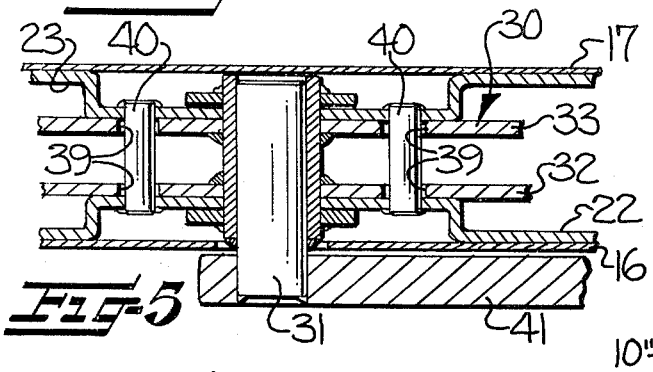
FIG. 5 is an enlarged sectional view similar to FIG. 4 showing the parts in cross-section.

As can be seen most clearly in FIG. 3, the rotatable plate assembly 30 includes a stub shaft 31 which extends perpendicular to the faces of the door, with one end of the stub shaft being located interiorly of the door adjacent the interior surface of the front panel 16, and with the opposite end portion of the stub shaft extending toward and through an opening provided in the rear panel 17. A pair of substantially square plates 32, 33 are secured to the stub shaft 31 in spaced apart substantially parallel relation.

Four elongate locking members 34, 35, 36 and 37, in the form of elongate bars of rectangular cross-section, are connected to the rotatable plate assembly 30 in such a manner that the locking members are moved longitudinally when the plate assembly 30 is rotated. More particularly, it will be seen that proximal end portions of the respective locking members 34–37 are positioned between the plates 32, 33 and are pivotally secured thereto by pins 38 which extend between the spaced-apart plates 32, 33 and through a hole provided in the respective proximal end portions of the locking members 34–37. The opposite or distal end portions of the respective locking members 34–37 are positioned respectively in the guide members 18 located on the respective upper, lower and opposing side edges of the door frame. Thus, when the plate assembly 30 is rotated, the respective locking members are moved longitudinally to protrude from the respective peripheral edges of the door and engage the adjoining door jamb structure and the floor to lockingly secure the door in place.

A pair of arcuate slots 39 are formed in each plate 32, 33, as is best seen from FIG. 3. A pair of pins 40 extend between the frame members 22, 23 and pass through the respective slots 39, thereby serving as stop means to limit the extent of rotatable movement of the plate assembly 30. Thus, when the pins 40 engage one end of the slots 39, the locking members 34–37 are in a fully retracted position, and when the pins 40 engage the opposite ends of the slots 39, the locking members 34–37 are in the fully extended position.

An operating lever 41, located on one outside surface of the door, is connected to the stub shaft 31 by suitable means such as a set screw 42, so as to facilitate rotating the plate assembly 30 interiorly of the door and thereby moving the locking members 34–37 from the retracted unlocked position to the extended locked position. As illustrated, the operating lever 41 includes a handle 43 to facilitate grasping the operating lever. Additionally, a pair of cooperating hasps 45, 46 are mounted respectively on the operating lever 41 and on the interior door panel 17 so as to have portions thereof overlying one another with an opening therethrough. A padlock may be positioned through the openings to permit lockingly securing the door in the locked position with the locking members extending from the peripheral edges of the door and in locking engagement with the adjoining door jamb structure.

Figure 6:
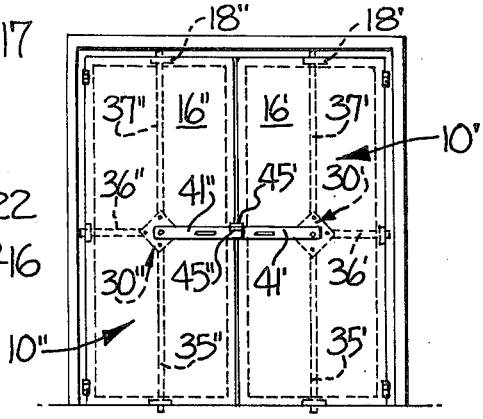
FIGS. 6 and 7 illustrate the security door assembly of the present invention as applied to a pair of side-by-side hinged double doors, showing the locking assemblies in the locked and unlocked positions respectively.
Figure 7:
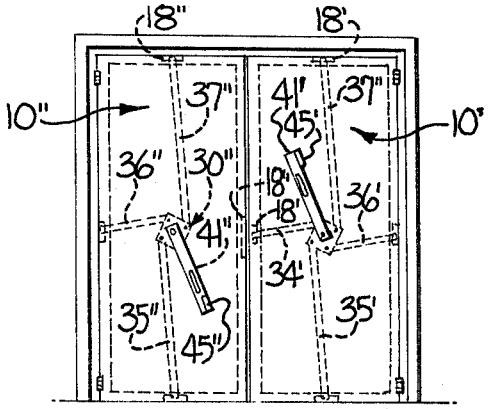
Figure 8:
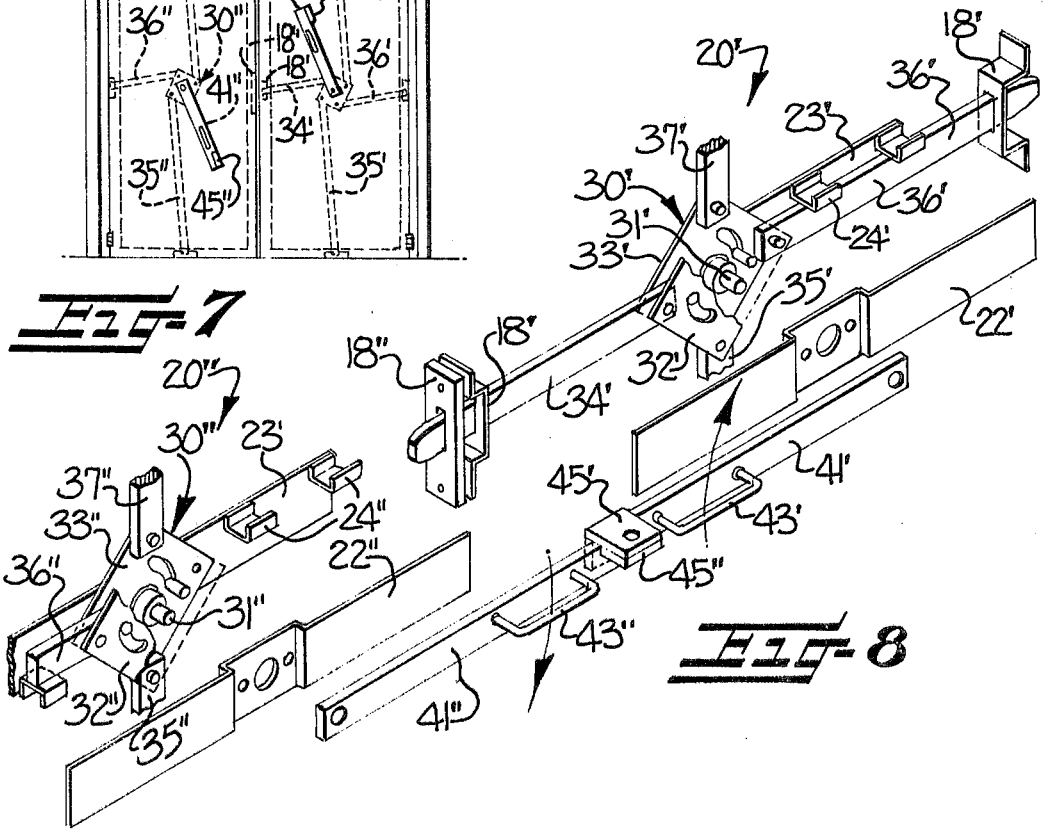
FIG. 8 is an enlarged exploded perspective view of the locking assemblies of FIGS. 6 and 7.

FIGS. 6–8 illustrate an alternate form of the invention wherein a side-by-side pair of double doors are hingedly connected along their respective outside edges to opposing vertically extending door jambs, with the respective inside edges of the doors being positioned in opposing relation. The various elements of this embodiment of the security door assembly are quite similar to those previously described with respect to FIGS. 1–5. To avoid repetitive description, the same reference characters previously used, with prime notation added, will be employed wherever applicable to identify previously described parts or elements.

In accordance with this embodiment of the invention, each of the doors has a locking assembly contained therein, and the respective locking assemblies cooperate to secure the doors to the adjoining door jamb structure, to the floor, and to one another.

In most double door arrangements, one of the doors is designated the active door, the other door being the inactive door. In such conventional arrangements, the inactive door is normally held closed by sliding bolts or other suitable means; and the active door is the one which is normally opened first when both doors are being opened, and the one which is opened when only one of the two doors is opened. In FIGS. 6 and 7, the active door is identified by the reference character 10′. It will be seen that this door is provided with a locking assembly of the type previously described with four elongate locking members 34′, 35′, 36′ and 37′.

The inactive door 10″ on the other hand, contains only three locking members 35″, 36″ and 37″, located for extending through the top, bottom and outside edge of the door. On the inactive door 10″, no locking member is provided for extending through the inside edge of the door which adjoins the opposing inside edge of the active door 10′. Instead, the guide member 18″ located on the inside edge of the inactive door 10″ serves as a socket for receiving the protruding end portion of the locking member 34′ of the active door 10′.

When the locking assemblies of the respective doors 10′, 10″ are in the extended locking position, as illustrated in FIGS. 6 and 8, the respective locking members securely engage each door with the adjoining door jamb structure and floor, and the opposing inside edges of the door are in locking engagement with one another also.

When in the locked position, the operating levers 41′, 41″ are positioned in cooperating engagement with the respective hasps 45′, 45″, which are carried by the operating lever, being positioned overlying one another for receiving a padlock in the openings therethrough so that the doors may be lockingly secured in the locked position.

In the drawings and specifications, there have been set forth preferred embodiments of the invention, and although specific terms are employed, they are used in a generic and descriptive sense only and not for purposes of limitation.

That which is claimed is:

1. A security door assembly adapted for securing the sides of a door in locking engagement with an adjacent door jamb structure, said door assembly comprising a rectangular frame having interconnected upper, lower, and opposing side members which collectively define the respective peripheral edges of the door; front and rear substantially rectangular panels mounted on opposite sides of said rectangular frame coextensive therewith and defining the front and rear faces of the door with a hollow interior portion located therebetween; respective openings provided in medial portions of each of the upper, lower, and opposing side members of said frame and communicating with the hollow interior portion of the door; respective guide means provided within the hollow interior portion of the door and adjacent the respective openings in the upper, lower and opposing side frame members of said door, rotatable plate means located within the hollow interior portion of the door; means cooperating with said rotatable plate means and with said frame and mounting said plate means for rotatable movement about a predetermined axis located medially of the plate means; four elongate locking members positioned within the hollow interior portion of the door, a distal end portion of each of said locking members cooperating with a respective one of said guide means and being positioned for protruding through a respective peripheral edge of the door; means cooperating with the proximal end portions of the respective elongate locking members for pivotally connecting the same to said rotatable plate means at locations radially spaced from said predetermined medial axis thereof so that when the plate means is rotated, the respective locking members are moved longitudinally to protrude from the respective peripheral edges of the door and engage the adjoining door jamb structure to lockingly secure the door in place; an operating lever located on the rear face of the door and cooperating with said rotatable plate means so as to permit manually rotating the same; and a pair of hasp means carried respectively by the rear face of said door and by said operating lever, said pair of hasp means having portions thereof overlying one another with an opening therethrough adapted for receiving a padlock so as to lockingly secure the door in locked position with the locking members extending from the peripheral edges of the door in locking engagement with the adjoining door jamb structure.

2. The structure according to claim 1 wherein said rotatable plate means is located adjacent the middle of the door and said locking members extend substantially perpendicular to the respective peripheral edges of the door.

3. The structure according to claim 1 wherein said means for mounting said plate means comprises an additional frame member extending between the opposing side members of the frame and located substantially equidistant between said upper and lower frame members.

4. The structure according to claim 3 wherein said additional frame member comprises a pair of spaced-apart substantially parallel elongate bars extending alongside and supporting the respective interior surfaces of said front and rear panels, the guide members on said opposing side frame members being connected to said bars at opposite ends thereof, and said rotatable plate means being located between the spaced-apart bars.

5. The structure according to claim 1 wherein said rotatable plate means includes a stub shaft extending perpendicular to the rear face of the door and having one end portion located interiorly of the door adjacent the interior surface of said front panel and the opposite end portion extending toward and through said rear panel, said operating lever being connected to said stub shaft, a pair of spaced-apart substantially parallel plates carried by said stub shaft, with said proximal end portions of said locking members being positioned therebetween, and said means pivotally connecting the locking members to said plate means comprising pins extending between the spaced-apart plates and through the respective proximal end portions of said locking members.

6. A security door assembly adapted for securing the respective sides of double doors in locking engagement with an adjacent door jamb structure, said assembly comprising a side-by-side pair of double doors hingedly connected along their respective outside edges to opposing vertically extending door jambs and positioned with their respective inside edges in opposing relation, one of said doors being the active door, the other being the inactive door; each door having a rectangular frame with interconnected upper, lower, and opposing side members which collectively define the respective peripheral edges of the door; front and rear substantially rectangular panels mounted on opposite sides of the respective frames coextensive therewith and defining the respective front and rear faces of the respective doors with respective hollow interior portions located therebetween; respective openings provided in medial portions of each of the upper, lower and opposing side members of said frames and communicating with the hollow interior portions of the doors; respective guide means provided within the hollow interior portions of the doors and adjacent the respective openings in the upper, lower and opposing side frame members of each of said doors, rotatable plate means located within the hollow interior portion of each of said doors; means in each of said doors cooperating with the respective rotatable plate means therein and with said frame means and mounting said plate means for rotatable movement about a predetermined axis located medially of the plate means; four elongate locking members positioned within the hollow interior portion of said active door, a distal end portion of each of said locking members cooperating with a respective one of said guide means and being positioned for protruding through a respective peripheral edge of the door; means cooperating with the proximal end portions of the respective elongate locking members for pivotally connecting the same to said rotatable plate means at locations radially spaced from said predetermined medial axis so that when the plate is rotated, the respective locking members are moved longitudinally to protrude from the respective peripheral edges of the active door and engage the adjoining door jamb structure and the opposing inside edge of the inactive door to lockingly secure the doors in place; three elongate locking members positioned within the hollow interior portion of said inactive door, a distal end portion of each of said locking members cooperating respectively with the guide means located on the upper, lower and outer side frame member of the inactive door and being positioned for protruding through a respective peripheral edge of the door; means cooperating with the proximal end portions of the respective elongate locking members for pivotally connecting the same to said rotatable plate means at locations radially spaced from said predetermined medial axis so that when the plate is rotated, the respective locking members are moved longitudinally to protrude from the respective upper, lower and outside peripheral edges of the inactive door and engage the adjoining door jamb, the guide means located on the inner side frame member of the inactive door being positioned for receiving the protruding end portion of the locking member of the adjacent active door; respective cooperating operating levers located on the inner face of the active door and the inactive door, said operating levers cooperating respectively with said pivot plates so as to permit manually rotating the same, and said operating levers, when positioned so as to locate the locking members in the extended locked position, having portions thereof overlying one another with an opening therethrough adapted for receiving a padlock so as to lockingly secure the doors in the locked position.

7. The structure according to claim 6 wherein said rotatable plate means in each of the doors is located adjacent the middle of the respective door and said locking members extend substantially perpendicular to the respective peripheral edges of the doors.

8. The structure according to claim 6 including handle means carried by each of said operating levers to facilitate manually positioning the same between the locked and unlocked position.

9. The structure according to claim 6 wherein said rotatable plate means in the hollow interior portion of each of said doors includes a stub shaft extending perpendicular to the rear face of the door and having one end portion located interiorly of the door adjacent the interior surface of said front panel and the opposite end portion extending toward and through said rear panel, said operating lever being connected to said stub shaft, a pair of spaced-apart substantially parallel plates carried by said stub shaft, with said proximal end portions of said locking members being positioned therebetween, and said means pivotally connecting the locking members to said plate means comprising pins extending between the spaced-apart plates and through the respective proximal end portions of said locking members.

10. The structure according to claim 9 including stop means cooperating with said plate means in each of said doors for limiting the extent of rotatable movement of the respective plate means, said stop means comprising an arcuate slot formed in said pair of spaced-apart plates, and a pin carried by the mounting means for said plate means and extending through said slot and cooperating therewith to limit movement of the plates by engagement of the pin with each end of the slot.

* * * * *